US006000686A

United States Patent [19]

Yates

[11] Patent Number: 6,000,686

[45] Date of Patent: Dec. 14, 1999

[54] LOCKING THREE-WAY CLAMP

[76] Inventor: W. Shuford Yates, 881 E. Hwy. 25-70, Newport, Tenn. 37821

[21] Appl. No.: 09/039,870

[22] Filed: Mar. 16, 1998

[51] Int. Cl.[6] ..... B25B 1/00

[52] U.S. Cl. ..... 269/6; 269/258; 269/170; 269/196; 269/229; 269/249; 269/143; 81/421

[58] Field of Search ..... 269/6, 96, 97, 269/143, 105, 170, 196, 197, 229, 249, 156, 224, 258; 81/421, 424

[56] References Cited

U.S. PATENT DOCUMENTS

| | | | |
|---|---|---|---|
| D. 260,476 | 9/1981 | Knaus | D8/55 |
| 3,263,535 | 8/1966 | Zurcher . | |
| 3,578,307 | 5/1971 | Lock | 269/96 |
| 3,590,669 | 7/1971 | Marasco | 81/372 |
| 3,718,327 | 2/1973 | Nunez | 269/37 |
| 3,807,718 | 4/1974 | Sendoykas | 269/6 |
| 4,238,123 | 12/1980 | Bardes | 269/258 |
| 4,601,221 | 7/1986 | Kalkbrenner et al. | 269/258 |
| 4,673,174 | 6/1987 | Tabbert | 269/258 |
| 4,747,588 | 5/1988 | Dillhoff | 269/258 |
| 4,795,141 | 1/1989 | Mulvaney | 269/41 |
| 5,143,359 | 9/1992 | Bush | 269/6 |
| 5,863,033 | 1/1999 | Bradford | 269/6 |

*Primary Examiner*—David A. Scherbel
*Assistant Examiner*—Lee Wilson
*Attorney, Agent, or Firm*—Pitts & Brittian, P.C.

[57] ABSTRACT

A locking, three-way clamp for applying a bi-directional vector force against one or more workpieces. The clamp 10, of the present invention, includes a handle 22, first and second opposing jaws 24 and 26, respectively, a jaw actuation lever 28, a threaded adjusting screw 30 and a toggle lock 32. Second opposing jaw 26 pivots, in relation to first jaw 24, about a central pivot point 34. First and second opposing jaws 24 and 26 each include a distal end 25 and 27, respectively. A workpiece restraint member 36 can be utilized for providing a rigid planar surface for engagement with a workpiece. The locking three-way clamp 10 of the present invention also includes an engagement device 50, on the distal end of each jaw, that pivots inward towards the restraint member 36 thus applying a vector force having x- and y-component vectors that forces a first workpiece against a second workpiece and simultaneously forcing the clamp 10 towards the workpieces 120 and 140. In one embodiment, the engagement devices are defined by a opposing, eccentrically mounted cams 60 pivotally secured proximate the distal ends 25 and 27 of the jaws 24 and 26. In a second embodiment, the engagement device 50' is defined by a linkage assembly 70 pivotally secured proximate the distal ends 25 and 27 of the jaws 24 and 26 of the clamp 10'. Each linkage assembly 70 pivots in relation to distal ends of the jaws about a first pivot point 74 and includes a workhead 52' that pivots in relation to linkage assembly 70 about a second pivot point 76.

8 Claims, 7 Drawing Sheets

LOCKING THREE-WAY CLAMP

TECHNICAL FIELD

This invention relates to the field of hand tools such as pliers and clamps. More particularly, it relates to a locking three-way clamp for securing two work pieces, such as a counter top and molding, together.

BACKGROUND ART

In the furniture and cabinet building trade, it is often necessary to utilize a three-way clamp in order to clamp a relatively small workpiece to a larger workpiece. For instance, it is often necessary to clamp a section of molding to the edge of a section of desktop or counter top while the molding is being secured, either with a mechanical fastener or an adhesive such as epoxy, to the larger workpiece. Typically, the artisan, or builder would utilize a traditional, state of the art three-way clamp. With the traditional three-way clamp, two of the work heads, are biased towards each other and towards the upper and lower surfaces of the larger workpiece. This linear, unidirectional force provides a stabile base against which the third workhead applies a second linear, unidirectional force which biases the smaller workpiece against the edge of the larger workpiece. However, there are at least two problems associated with using the traditional three-way clamp in this manner: one, each workhead must be individually manipulated in order to apply the linear, unidirectional force against the workpieces; and two, the two opposing linear, unidirectional forces must be set first, after which the third force is set, however, depending upon the surface and surface area of the two opposing workheads, the force necessary to overcome the frictional force between the opposing workheads and the surface of the large workpiece may be less than the second linear force applied by the third workpiece. The result is that the third workpiece actually forces the clamp off of the workpieces. Various clamping devices are known in the art: For instance, U.S. Pat. No. 3,590,669, issued to Marasco, on Jul. 6, 1971 discloses improved pliers with a toggle-type grip lock. U.S. Pat. No. 3,578,307, issued to Lock, on May 11, 1971, discloses an improved "Stilson"-type pipe wrench. U.S. Pat. No. 3,718,327, issued to Nunez, on Feb. 27, 1973, discloses a portable vice formed from a c-clamp that has been adapted for rigid mounting to a structural member and that is provided with auxiliary clamp means that cooperate with the c-clamp. U.S. Pat. No. 3,807,718, issued to Sendoykas, on Apr. 30, 1974, discloses a novel linkage assembly for toggle actuated clamping devices. U.S. Des. Pat. No. Des. 269,476, issued to Knaus, on Sep. 1, 1981, discloses an ornamental design for a combined locking pliers clamp. And, U.S. Pat. No. 4,795,141, issued to Mulvaney, on Jan. 3, 1989, discloses a cam locked fixture for stabilizing the position of a stud during nailing.

What is heretofore missing from the art is a locking three-way clamp that provides the ease of adjustment of the traditional locking pliers while applying a vector force that has both horizontal and vertical component vectors that bias the clamp against two workpieces rather than working to force the clamp off of the workpiece.

Accordingly, it is an object of the present invention to provide a locking clamp that includes a workpiece restraint member and an engagement device which pivots inward towards the restraint member thus applying a vector force having a component vector towards the workpiece and a component vector towards the restraint member.

Another object of the present invention is to provide a locking clamp in which the engagement device is defined by a pair of opposing, eccentrically mounted cams.

A further object of the present invention is to provide a locking clamp in which the engagement device is defined by a pair of linkages pivotally secured to the jaws of the clamp, each linkage including a pivotally mounted workhead.

Other objects and advantages over the prior art will become apparent to those skilled in the art upon reading the detailed description together with the drawings as described as follows.

DISCLOSURE OF THE INVENTION

In accordance with the various features of this invention, a locking, three-way clamp is provided. The locking three-way clamp includes a handle, threaded adjusting screw and toggle lock typical of state of the art locking c-clamps or locking pliers. Opposing jaws that are in spaced relation are also provided. A workpiece restraint member is provided at the conjunction of the jaws and proximate the central pivot point around which the jaws pivot. The locking three-way clamp of the present invention also includes an engagement device disposed on the distal end of each jaw. Each engagement device includes a workhead that defines a point of contact between the clamp and a workpiece. Upon closure of the jaws such that the workhead engages the workpiece, the engagement device pivots inward towards the restraint member thus applying a vector force having a component vector towards the workpiece and a component vector towards the restraint member. Rather than overcoming the frictional force between the opposing workheads and the workpiece and forcing the three-way clamp off of the workpiece, as is problematic with state of the art three-way clamps, the resultant vector force forces the workpiece against the restraint member and forces the clamp towards the workpiece.

In one embodiment of the locking three-way clamp, the engagement device is defined by a pair of opposing, eccentrically mounted cams. In this regard, opposing cams are pivotally connected at the distal end of each jaw. The cams each rotate around the cam's eccentrically positioned pivot point. The cams are, preferably, spring-biased away from the closed position. Moreover, the cam is mounted such that the radius between the central pivot point of the clamp and the eccentrically positioned cam pivot is greater than the radius between the central pivot point of the clamp and the point of contact of the cam with the workpiece and further such that the point of contact of the cam with the workpiece is disposed inside a line between cam pivot points. This configuration allows the cams to rotate towards the restraint member when the jaws are closed and the cams engage the workpiece. As a result of this rotation, a bidirectional vector force which has essentially x- and y- component vectors is applied against the workpieces. This results in the workpieces being biased towards the restraint member.

In another embodiment of the locking three-way clamp, the engagement device is defined by a linkage assembly pivotally secured proximate the distal end of each jaw of the clamp, each linkage assembly including a pivotally mounted workhead. In this regard, the linkage assembly has first end pivotally secured proximate the distal end of the jaw. The linkage assembly is spring biased towards the open position. Further, the distal end of the jaw is inclined so as to permit flexion of the linkage assembly towards the restraint member. The second end of the linkage assembly is pivotally secured to the workhead. The workhead includes a pad for providing a point of contact with the workpiece. In the preferred embodiment, the pad is substantially planar. The first and second pivot points are in spaced relation to each other and are configured such that the radius between the central pivot point of the clamp and the first pivot point is greater than the radius between the central pivot point of the clamp and the second pivot point and further such that the second pivot points are disposed inside a line between the first pivot points when the pad engages the workpiece. This configuration results in application of a bidirectional vector force which has x- and y- component vectors upon closure of the jaws and engagement of the workheads against the workpiece.

It will be appreciated that the surfaces of the pads and the cams can either be smooth, textured or coated with a compressible coating, such as a neoprene coating depending upon the type of workpieces that will be engaged.

BRIEF DESCRIPTION OF THE DRAWINGS

FIG. 7*b* being a side elevation view in partial cross-section.

BEST MODE FOR CARRYING OUT THE INVENTION

Figure 1:
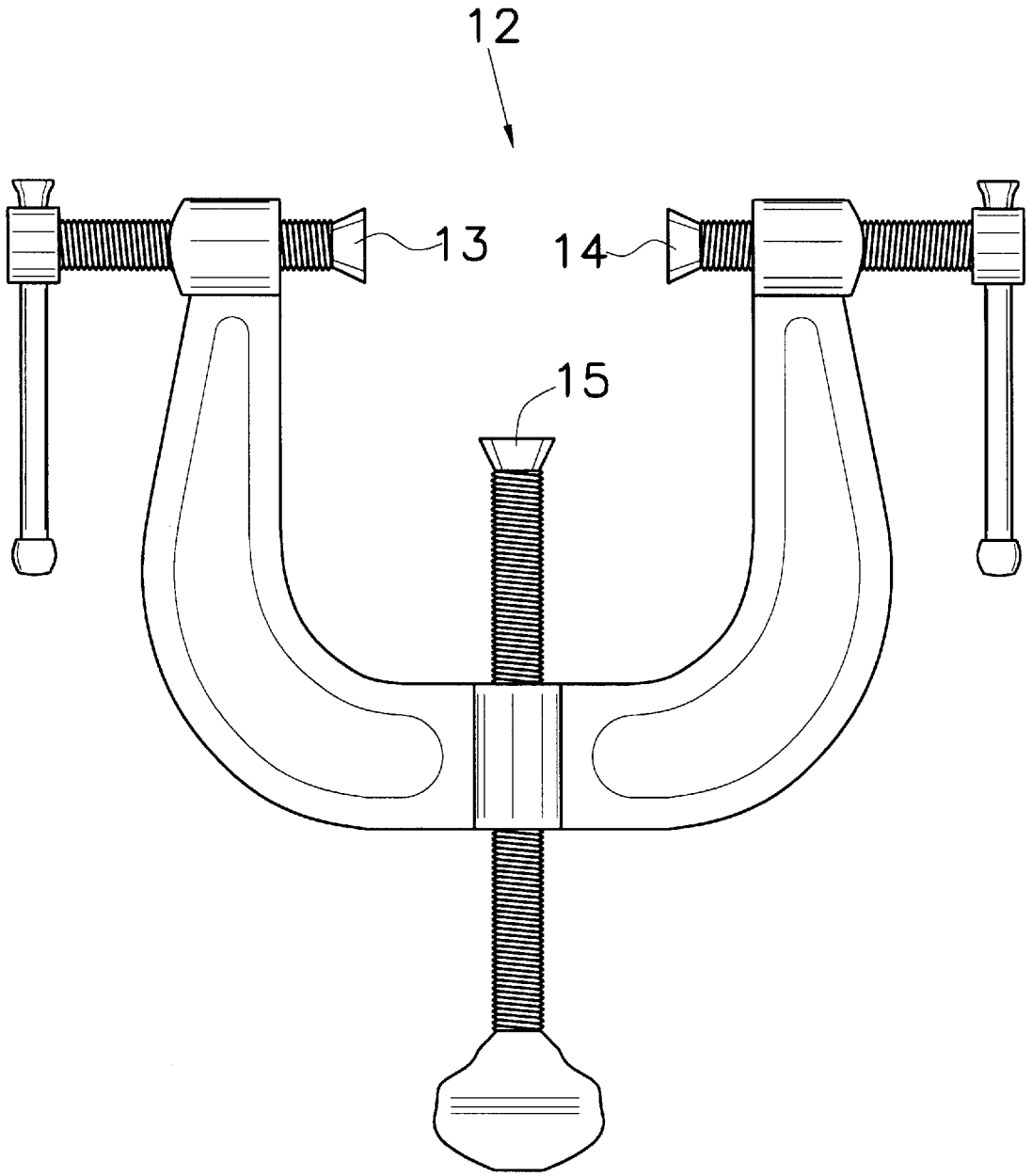
Fig. 1 (PRIOR ART)
FIG. 1 illustrates a side elevation view of a prior art three-way clamp.
Figure 2:
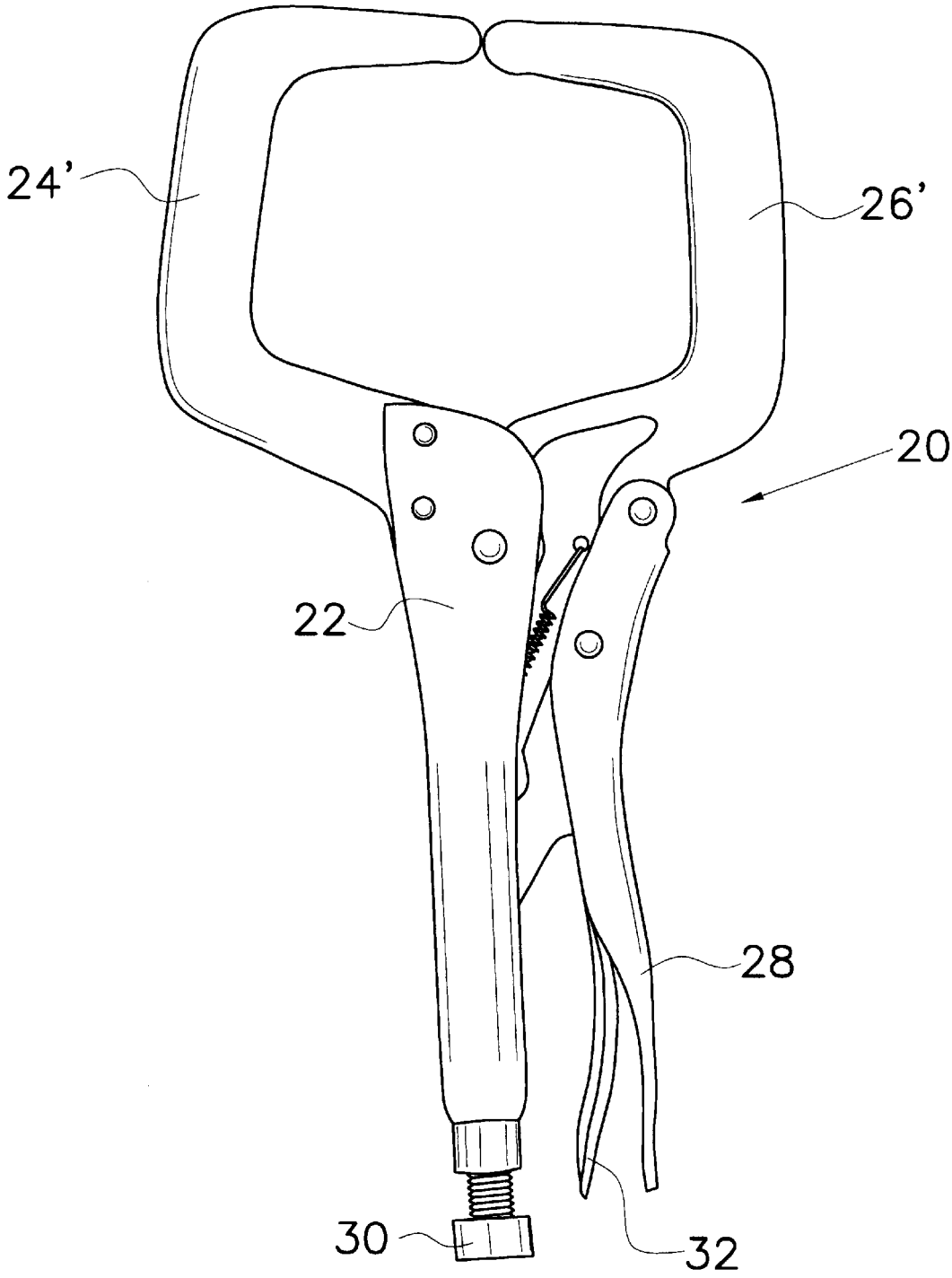
Fig.2 (PRIOR ART)
FIG. 2 illustrates a side elevation view of a prior art locking C-clamp.

A locking, three-way clamp, constructed in accordance with the present invention, is illustrated generally as 10 in the figures. It will be appreciated by those skilled in the art that a traditional, state-of-the-art c-clamp 12, as illustrated in FIG. 1, includes threaded, adjustable opposing workheads 13 and 14 and a third threaded, adjustable workhead 15. It will also be appreciated by those skilled in the art, that a typical, locking c-clamp 20 includes a handle 22, first and second opposing jaws 24' and 26', respectively, disposed proximate a distal end of the handle 22 and that are in spaced relation to one another, a jaw actuation lever 28 for actuating the jaws 24' and 26', a threaded adjusting screw 30 for selecting the spacing of the jaws 24' and 26' from one another when the jaws 24' and 26' are in the locked, or closed, position and toggle lock 32 for selectively locking and unlocking the jaws 24' and 26'. The clamp 10, of the present invention, includes a handle 22, first and second opposing jaws 24 and 26, respectively, disposed proximate a distal end of the handle 22 and that are in spaced relation to one another, a jaw actuation lever 28 for actuating the jaws 24 and 26 proximate handle 22 and substantially parallel to the handle 22, a threaded adjusting screw 30 for selecting the spacing of the jaws 24 and 26 from one another when the jaws 24 and 26 are in the locked, or closed, position and toggle lock 32 for selectively locking and unlocking the jaws 24 and 26. Second opposing jaw 26 pivots, in relation to first jaw 24, about a central pivot point 34. First and second opposing jaws 24 and 26 each include a distal end 25 and 27, respectively. A workpiece restraint member 36 is provided at the conjunction of first and second jaws 24 and 26 and proximate the central pivot point 34. The workpiece restraint member 36 is rigid and has a secured end 38 pivotally secured to one of the jaw members, preferably first jaw 24, and a distal end 40 that engages the inside edge of second jaw 26. Restraint member 36 provides a rigid planar surface for engagement with a workpiece, such as workpiece 120 in the figures.

The locking three-way clamp 10 of the present invention also includes an engagement device 50 disposed on the distal end of each jaw. Each engagement device includes a workhead 52 that engages the workpiece 140. Upon closure of the jaws 24 and 26, such that the workhead 52 engages the workpiece 140, the engagement device 50 pivots inward towards the restraint member 36 thus applying a vector force having a component vector, in the direction of arrow 58, towards the workpiece 140 and a component vector, in the direction of arrow 55, towards the restraint member 36. Rather than overcoming the functional force between the opposing workheads and the workpiece and forcing the three-way clamp 10 off of the workpiece, as is problematic with state of the art three-way clamps, the resultant vector force forces the workpiece 140 against workpiece 120 while forcing workpiece 120 against the restraint member 36 and thereby forces the clamp 10 towards the workpieces 120 and 140.

In one embodiment of the locking three-way clamp 10, the engagement devices are defined by a opposing, eccentrically mounted cams 60 pivotally secured proximate the distal ends 25 and 27 of the jaws 24 and 26. In this regard, a cam 60 is pivotally connected at the distal end 25 of the first jaw 24 and a second cam 60 is pivotally connected at the distal end 27 of the second jaw 26. Each cam 60 rotates around its eccentrically positioned pivot point 65. The cams are, preferably, biased towards a non-rotated position when jaws 24 and 26 are in an open position, this biasing is preferably accomplished by a spring, (not shown). Moreover, the cam 60 and pivot point 65 are positioned relative to the distal end of the jaw such that the radius between the central pivot point 34 of the clamp 10 and the eccentrically positioned cam pivot 65 is greater than the radius between the central pivot point 34 of the clamp 10 and the point of contact of the cam 60 with the workpiece 140 further such that the point of contact of each cam 60 with the workpiece is disposed inside a line between the pivot points 65 when the pad engages the workpiece. This configuration allows the cams 60 to rotate in the direction of arrow 68 towards the restraint member 36 when the jaws 24 and 26 are closed and the cams 60 engage the workpiece 140. As a result of this rotation, a bi-directional vector force which has essentially x- and y- component vectors is applied against the workpieces. This results in the workpieces being biased towards the restraint member.

Figure 5:
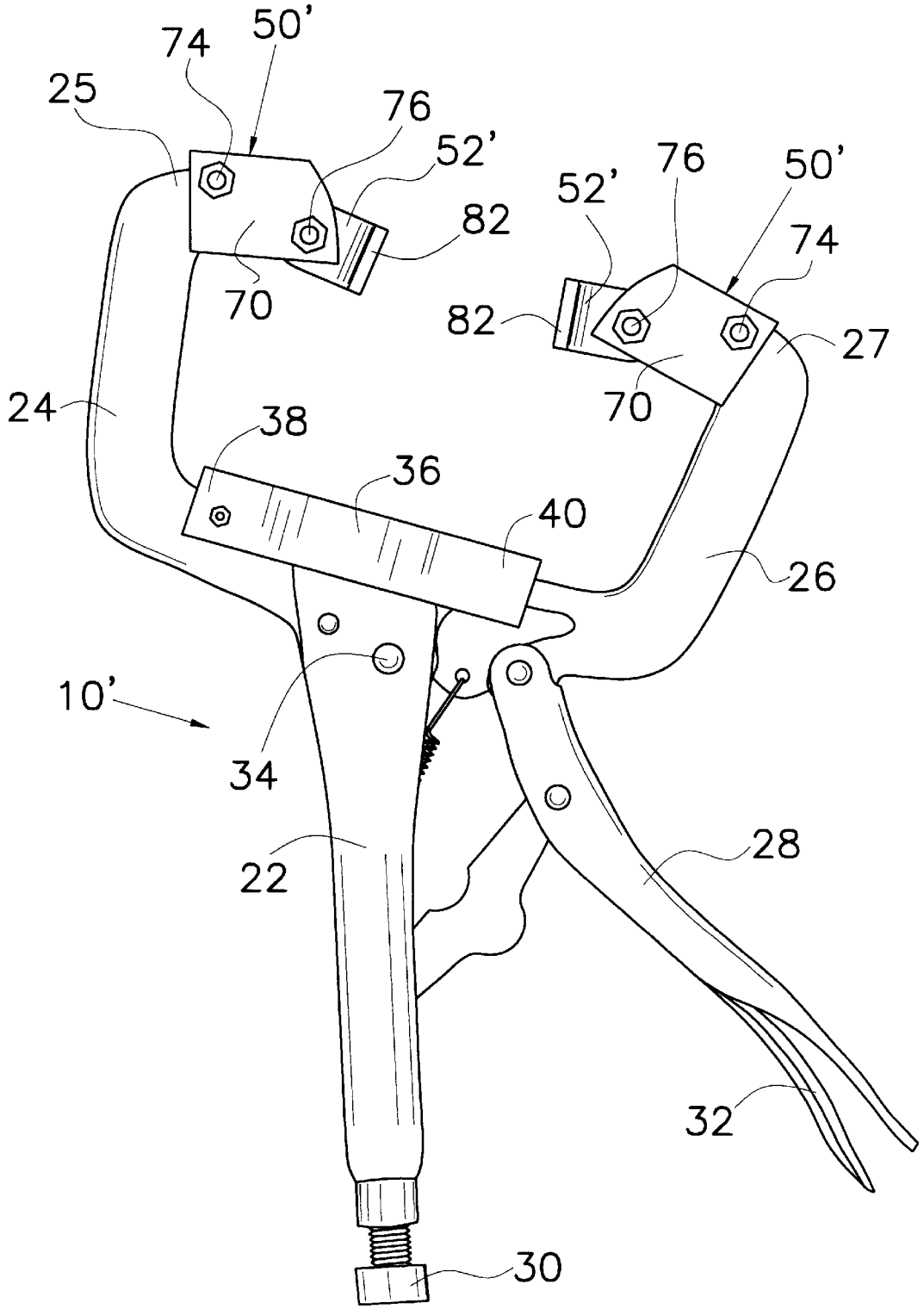
FIG. 5 illustrates a side elevation view of the locking three-way clamp of the present invention in which the engagement device defines a pair of linkages pivotally secured to the jaws of the clamp, each linkage including a pivotally mounted workhead.
Figure 6A:
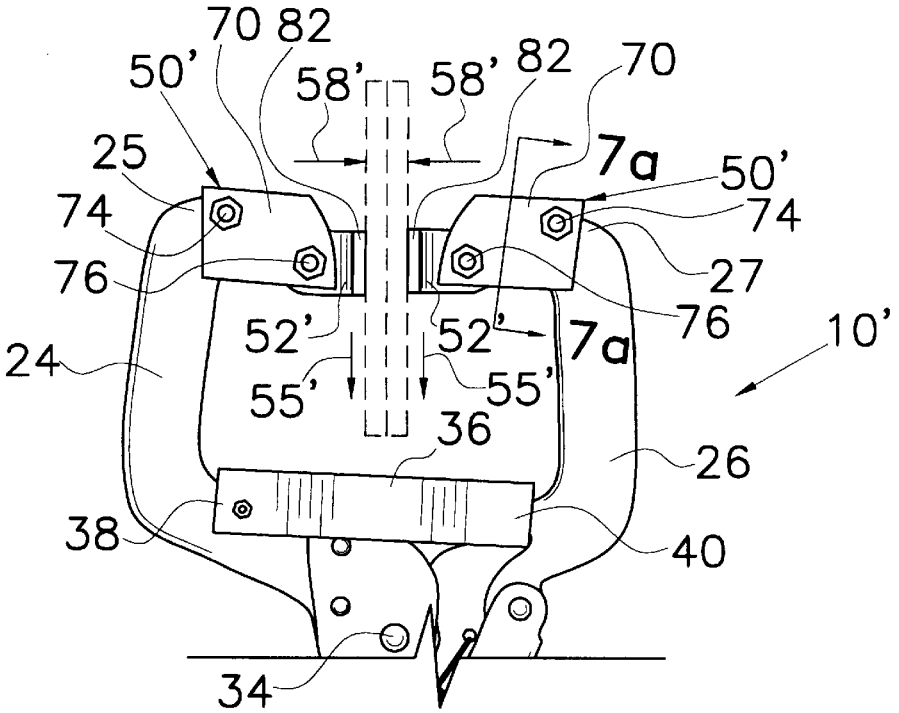
FIG. 6*a* illustrates a partial side elevation view of the device shown in FIG. 5 showing the clamp being used as a typical c-clamp.
Figure 6B:
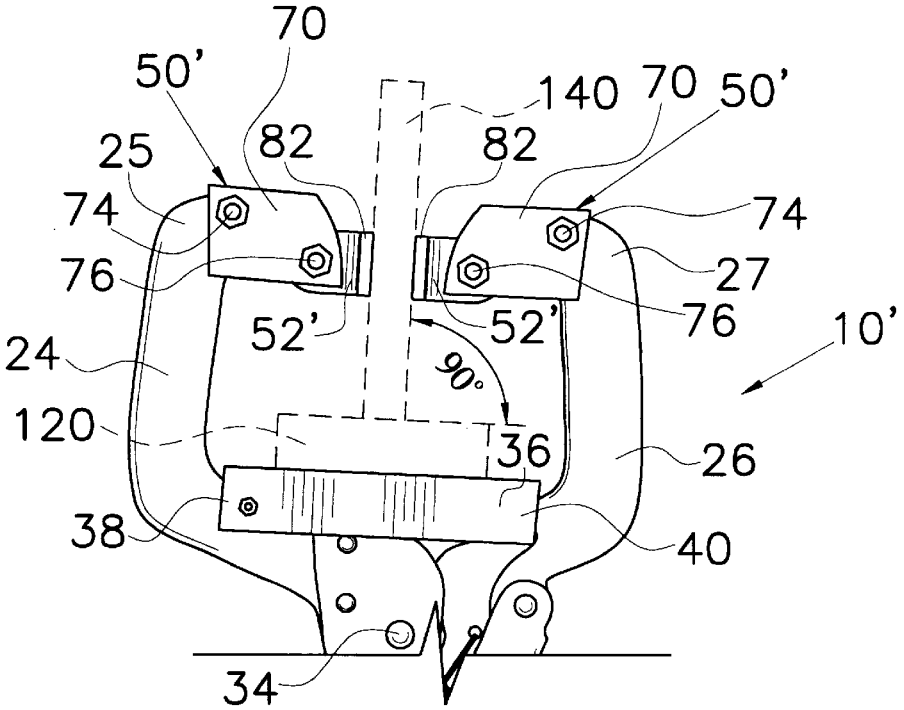
FIG. 6*b* illustrates a partial side elevation view of the device shown in FIG. 5 showing the clamp being used as a three-way clamp.
Figure 7A:
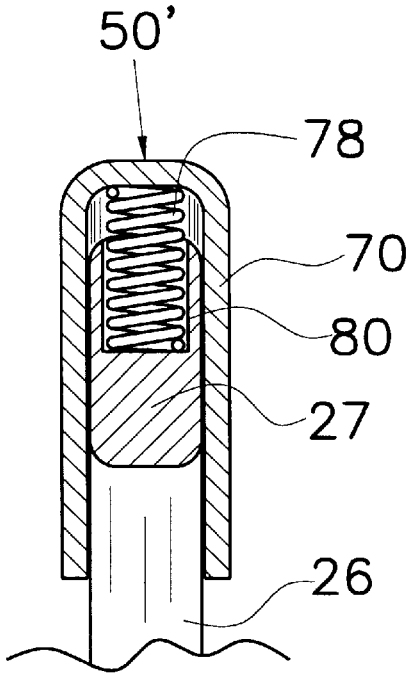
FIGS. 7*a* and 7*b* illustrate partial cross-sectional views of the device shown in FIG. 5, FIG. 7*a* being a partial end view cross-section taken at line 7*a*–7*a*.
Figure 7B:
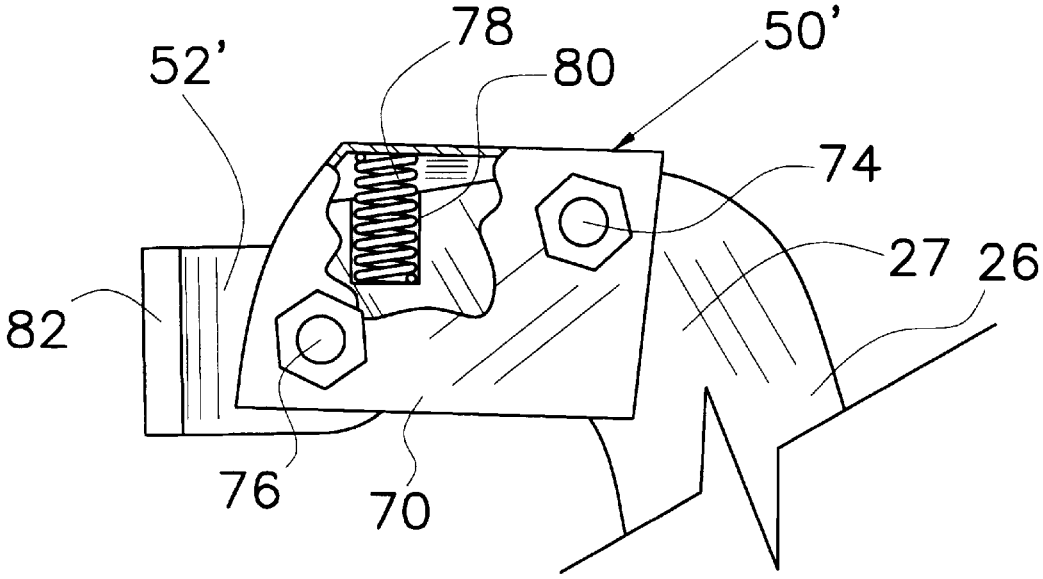

Referring to FIGS. 5–7, an alternate embodiment is illustrated with common components bearing the same reference numerals. Comparable but distinctive parts bear the same reference numeral with the prime notation added, and parts not previously described bear their own reference numerals. In this regard, in the alternate embodiment of the locking three-way clamp 10', the engagement device 50' is defined by a linkage assembly 70 pivotally secured proximate the distal ends 25 and 27 of the jaws 24 and 26 of the clamp 10'. Each linkage assembly 70 pivots in relation to distal ends 25 and 27 of the jaws 24 and 26 about a first pivot point 74. Each linkage assembly 70 includes a pivotally mounted workhead 52' that pivots in relation to linkage assembly 70 about a second pivot point 76. The linkage assembly 70 is spring biased towards an open position by a spring 78 which, preferably, is seated in a recess 80 in the distal ends 25 and 27 of the jaws 24 and 26. Further, the distal ends 25 and 27 of the jaws 24 and 26 are inclined so as to permit flexion of the linkage assembly 70 towards the restraint member 36. The workhead 52' includes a pad 82 for providing a point of contact with the workpiece. In the preferred embodiment, the pad 82 is substantially planar. The first and second pivot points 74 and 76, respectively, are in spaced relation to each other and are configured such that the radius between the central pivot point 34 of the clamp 10' and the first pivot point 74 is greater than the radius between the central pivot point 34 of the clamp 10' and the second pivot point 76 further such that the second pivot points 76 are disposed inside a line between the first pivot points 74 when the pad 82 engages the workpiece. This configuration results in application of a bidirectional vector force against workpieces 140 and 120 and restraint member 36 when the first and second jaws, 24 and 26, are closed and engage workpiece 140. In this regard, the bidirectional vector force includes an x-component vector in the direction of arrow 58' and a y-component vector in the direction of arrow 55'.

Figure 3:
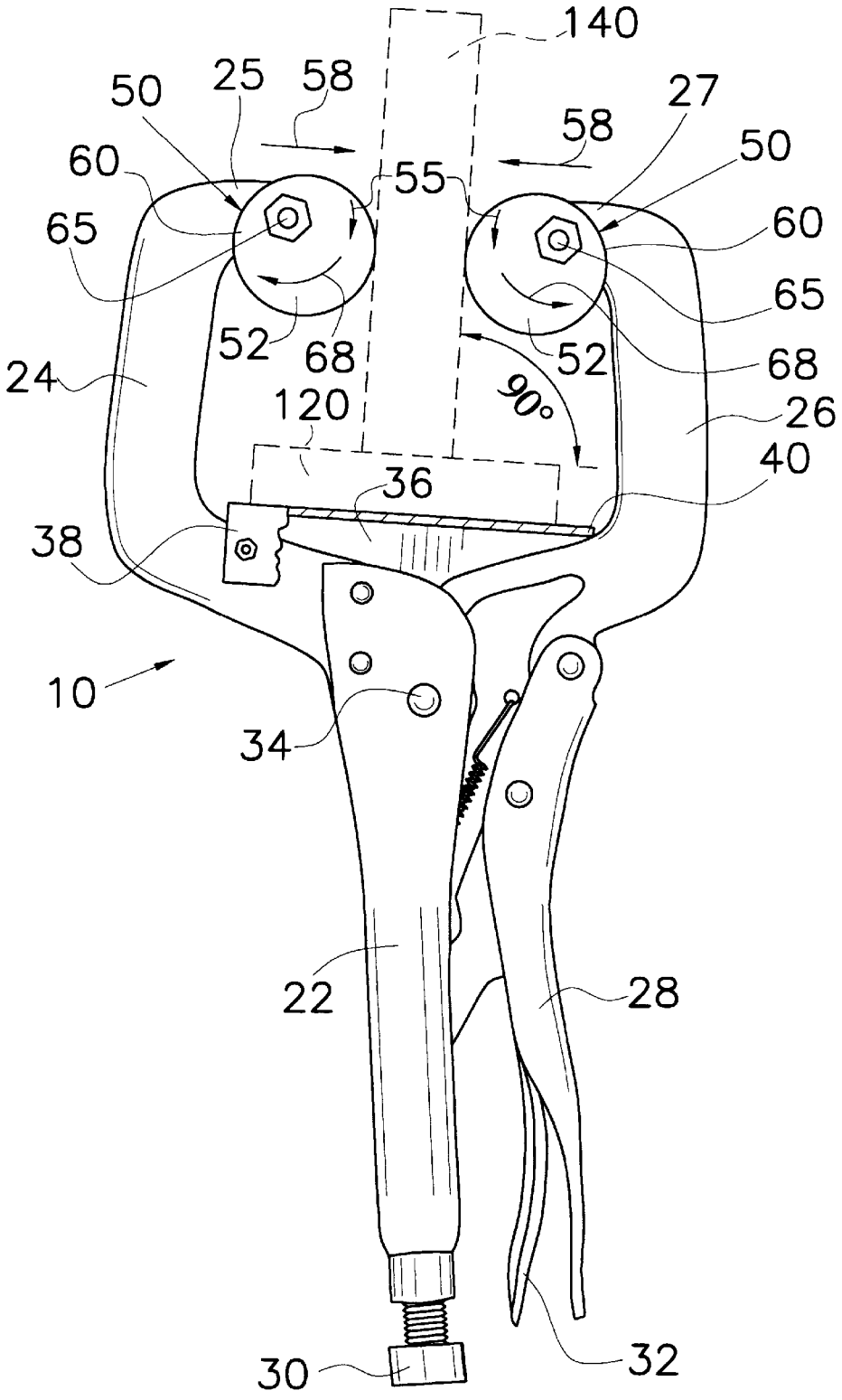
FIG. 3 illustrates a side elevation view of the locking three-way clamp of the present invention in which eccentrically mounted cams are utilized as the engagement devices.
Figure 4:
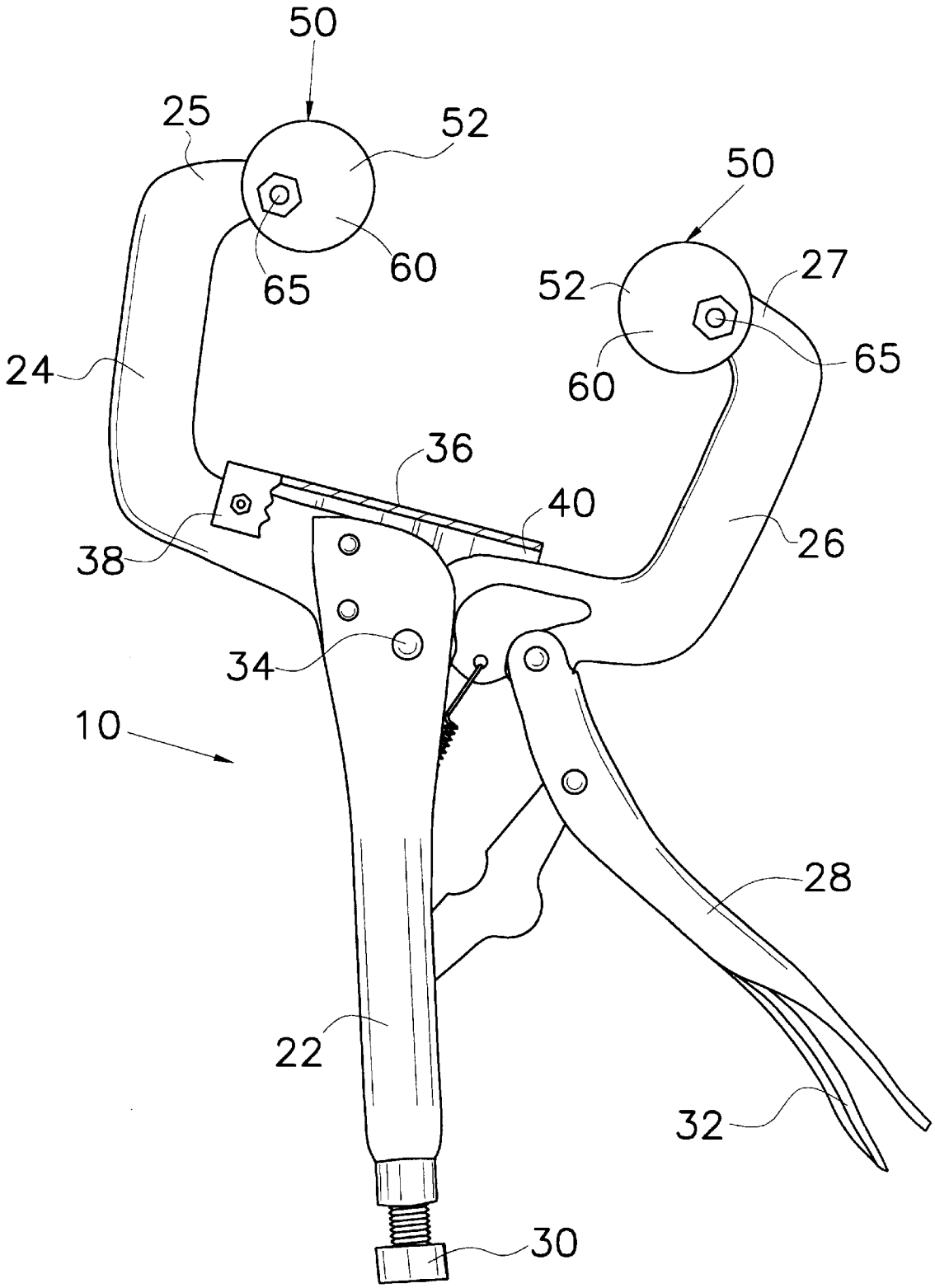
FIG. 4 illustrates a side elevation view of the device shown in FIG. 3 in which the jaws are in the open position.

As shown in FIGS. 3 and 6*b,* the restraint member provides a solid base against which the bidirectional vector forces can act and also maintains a substantially perpendicular relationship between workpieces 120 and 140. Moreover, it will be appreciated by those skilled in the art that in applications where maintaining the workpieces in substantially a perpendicular, or 90°, relationship is not necessary, that restraint member 36 can be omitted from either clamp 10 or 10'. Absent the restraint member 36, workpiece 120 would abut clamp 10 or 10' proximate the conjunction of jaws 24 and 26. It will also be appreciated that the surfaces of the pads 82 and the cams 60 can either be smooth, textured or coated with a compressible coating, such as a neoprene coating depending upon the type of workpieces 140 that will be engaged by either clamp 10 or 10'.

From the foregoing description, it will be recognized by those skilled in the art that a locking three-way clamp offering advantages over the prior art has been provided. The locking, three-way clamp of the present invention provides the ease of adjustment of traditional locking pliers while applying a bi-directional vector force that has both horizontal and vertical component vectors that bias the clamp against two workpieces rather than working to force the clamp off of the workpiece. The locking clamp of the present invention includes, in the preferred embodiment, a workpiece restraint member and an engagement device which pivots inward towards the restraint member thus applying a vector force having a component vector towards the workpiece and a component vector towards the restraint member. According to the present invention, in one embodiment of the locking clamp, the engagement device is defined by a pair of opposing, eccentrically mounted cams. In a further embodiment, of the locking clamp of the present invention, the engagement device is defined by a pair of linkages pivotally secured to the jaws of the clamp, each linkage including a pivotally mounted workhead.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A locking three way clamp, said locking three way clamp comprising;

a handle;

first and second opposing jaws disposed proximate a distal end of said handle, said first and second opposing jaws each having a distal end, said first and second opposing jaws being in spaced relation to one another, wherein said second jaw pivots in relation to said first jaw about a central pivot point;

a jaw actuation lever for actuating the jaws proximate said handle;

a threaded adjusting screw for selectively spacing of said first and second opposing jaws apart from one another when said first and second opposing jaws are in a closed position;

a toggle lock for selectively locking and unlocking said first and second opposing jaws in said closed position;

a rigid workpiece restraint member disposed proximate a conjunction of said first and second opposing jaws and proximate said central pivot point, said restraint member having a first end pivotally secured to one of said first and second opposing jaws and a second distal end; and a pivoting cam member disposed proximate each said distal end of said first and second opposing jaws, wherein said cam rotates around an eccentrically positioned pivot point, said cam and said eccentric pivot point being selectively positioned such that a first selected radius between said central pivot point and said eccentric pivot point is greater than a second selected radius between said central pivot point and a point of contact of said cam with said first workpiece, and further such that said point of contact of each said cam with said workpiece is disposed inside a line between each said eccentric pivot point, whereby engagement of said cams against said first workpiece and locking said first and second opposing jaws in said closed position results in application of a bidirectional vector force against said first workpiece.

2. The locking three way clamp of claim 1 wherein said bidirectional vector force includes a substantially horizontal component vector and a substantially vertical component vector.

3. The locking three way clamp of claim 1 wherein each said cam is biased towards a non-rotated position when said first and second opposing jaws are in an open position.

4. A locking three way clamp, said locking three way clamp comprising;

a handle;

first and second opposing jaws disposed proximate a distal end of said handle, said first and second opposing jaws each having a distal end, said first and second opposing jaws being in spaced relation to one another, wherein said second jaw pivots in relation to said first jaw about a central pivot point;

a jaw actuation lever for actuating the jaws proximate said handle;

a threaded adjusting screw for selectively spacing of said first and second opposing jaws apart from one another when said first and second opposing jaws are in a closed position;

a toggle lock for selectively locking and unlocking said first and second opposing jaws in said closed position;

a rigid workpiece restraint member disposed proximate a conjunction of said first and second opposing jaws and proximate said central pivot point, said restraint member having a first end pivotally secured to one of said first and second opposing jaws and a second distal end; and a linkage assembly having first and second ends, said first end being pivotally secured at a first pivot point proximate each said distal end of said first and second opposing jaw, said second end of said linkage assembly being pivotally secured at a second pivot point to a workhead, wherein in said workhead pivots in relation to said linkage assembly, said first pivot point and said second pivot point being in spaced relation and configured such that a first selected radius between said central pivot point and said first pivot point is greater than a second selected radius between said central pivot point and said second pivot point, and further such that each said second pivot point is disposed inside a line between each said first pivot point when said workhead engages a workpiece, thereby resulting in application of a bi-directional vector force against said first workpiece when said first and second opposing jaws engage said first workpiece and are locked in said closed position.

5. The locking three way clamp of claim 4 wherein each said linkage assembly is spring biased towards an open position by a spring.

6. The locking three way clamp of claim 4 wherein each said spring is seated in a recess disposed in each said distal end of said first and second opposing jaws.

7. The locking three way clamp of claim 4 wherein each said distal end is inclined to facilitate flexion of said linkage assembly towards said central pivot point.

8. The locking three way clamp of claim 4 wherein each said workhead further includes a substantially planar pad for engaging said first workpiece.

* * * * *